US011428033B2

(12) United States Patent
Beutel et al.

(10) Patent No.: US 11,428,033 B2
(45) Date of Patent: Aug. 30, 2022

(54) PRE-ASSEMBLED FITTING GROUP AND FITTING ASSEMBLY FOR A WINDOW OR A DOOR

(71) Applicant: Roto Frank Fenster—und Tuertechnologie GmbH, Leinfelden-Echterdingen (DE)

(72) Inventors: Michael Beutel, Waldenbuch (DE); Erkan Balci, Filderstadt (DE); Zsolt Varsányi, Sopron (HU); Udo Pastrich, Pliezhausen (DE); Martin Krebs, Stuttgart (DE); Winfried Reich, Berglen (DE); Richard Erb, Waldenbuch (DE); Ulrich Pfeiffer, Hemmingen (DE); Joerg Boenkendorf, Boeblingen (DE)

(73) Assignee: Roto Frank Fenster—und Tuertechnologie GmbH, Leinfelden-Echterdingen (DE)

( * ) Notice: Subject to any disclaimer, the term of this patent is extended or adjusted under 35 U.S.C. 154(b) by 0 days.

(21) Appl. No.: 17/251,427

(22) PCT Filed: Jul. 2, 2019

(86) PCT No.: PCT/EP2019/067685
§ 371 (c)(1),
(2) Date: Dec. 11, 2020

(87) PCT Pub. No.: WO2020/007830
PCT Pub. Date: Jan. 9, 2020

(65) Prior Publication Data

US 2021/0317692 A1 Oct. 14, 2021

(30) Foreign Application Priority Data

Jul. 6, 2018 (DE) ..... 10 2018 116 417.3

(51) Int. Cl.
*E05D 15/06* (2006.01)

(52) U.S. Cl.
CPC ..... *E05D 15/0665* (2013.01); *E05D 15/0691* (2013.01); *E05Y 2201/692* (2013.01); *E05Y 2900/132* (2013.01); *E05Y 2900/148* (2013.01)

(58) Field of Classification Search
CPC ..... E05D 15/0665; E05D 15/0691; E05D 15/1042; E05D 15/0682; E05D 15/10; E05D 2015/1039
(Continued)

(56) References Cited

U.S. PATENT DOCUMENTS 3,660,936 A * 5/1972 Bryson ..... E05D 15/10 49/209
4,341,043 A * 7/1982 Yamamoto ..... E06B 7/18 49/209
(Continued)

FOREIGN PATENT DOCUMENTS

CN 203835107 U 9/2014
CN 105492713 A 4/2016
(Continued)

OTHER PUBLICATIONS

International Search Report dated Oct. 11, 2019 issued in PCT/EP2019/067685 (with English translation).
(Continued)

*Primary Examiner* — Marcus Menezes
(74) *Attorney, Agent, or Firm* — Collard & Roe, P.C.

(57) ABSTRACT

A pre-assembled fitting group for a window or door has a drive rod portion, which is movable in the rebate circumferential direction, a first control element, and a second control element which is arranged on a cross slide. The first and the second control elements cooperate and are coordinated with one another in such a way that a displacement of
(Continued)

the first control element by the drive rod portion causes a displacement of the cross slide. A guide part that can be fixedly mounted on the sash, wherein the cross slide is at least partially movable relative to the guide part.

19 Claims, 5 Drawing Sheets

(58) Field of Classification Search
USPC ..... 49/209, 210
See application file for complete search history.

(56) References Cited

U.S. PATENT DOCUMENTS

| | | | | |
|---|---|---|---|---|
| 5,012,611 | A * | 5/1991 | Hsu | E06B 7/18 49/225 |
| 7,845,116 | B2 * | 12/2010 | Masuda | E05D 15/1065 49/223 |
| 10,077,594 | B2 * | 9/2018 | Fingerle | E05B 17/0025 |
| 11,085,216 | B2 * | 8/2021 | Reich | E05D 15/10 |
| 2009/0038228 | A1 * | 2/2009 | Lee | E06B 7/23 49/360 |
| 2019/0071910 | A1 * | 3/2019 | Alban | E05D 15/0665 |
| 2019/0292828 | A1 * | 9/2019 | Liu | E06B 5/20 |

FOREIGN PATENT DOCUMENTS

| | | | | | |
|---|---|---|---|---|---|
| CN | 105909155 | A | * | 8/2016 | E06B 3/08 |
| CN | 107075891 | A | | 8/2017 | |
| CN | 206448667 | U | | 8/2017 | |
| DE | 202005013428 | U1 | | 12/2005 | |
| DE | 102011055037 | A1 | | 5/2013 | |
| DE | 202013104879 | U1 | | 12/2013 | |
| DE | 102014220837 | B3 | | 1/2016 | |
| DE | 102014220837 | B3 | * | 1/2016 | E05D 15/10 |
| DE | 102016225385 | A1 | * | 6/2018 | E05D 15/10 |
| EP | 2829679 | A1 | | 1/2015 | |
| FR | 2833209 | A1 | * | 6/2003 | E05D 15/1047 |
| KR | 10-2012-0050035 | A | | 5/2012 | |
| KR | 101254327 | B1 | | 4/2013 | |
| KR | 10-2013-0085834 | A | | 7/2013 | |
| WO | 2015/010925 | A1 | | 1/2015 | |
| WO | WO-2015082325 | A1 | * | 6/2015 | E05D 15/10 |

OTHER PUBLICATIONS

German Office action dated Mar. 25, 2019 issued in the corresponding German Application No. 10 2016 116 417.3 (with English translation of relevant parts).
English Translation of International Preliminary Report on Patentability dated Jan. 12, 2021 in PCT/EP2019/067685.
Chinese Office Action with Search Report dated Feb. 11, 2022 issued in Chinese Application No. 201980045517.3 (with English translation of relevant parts).

* cited by examiner

PRE-ASSEMBLED FITTING GROUP AND FITTING ASSEMBLY FOR A WINDOW OR A DOOR

CROSS REFERENCE TO RELATED APPLICATIONS

This application is the National Stage of PCT/EP2019/067685 filed on Jul. 2, 2019, which claims priority under 35 U.S.C. § 119 of German Application No. 10 2018 116 417.3 filed on Jul. 6, 2018, the disclosures of which are incorporated by reference. The international application under PCT article 21(2) was not published in English.

BACKGROUND OF THE INVENTION

The invention relates to a fitting assembly for a window or a door and a window or a door.

From EP 2 829 679 A1 a fitting assembly has become known which has a guide part that can be fixedly arranged on a wing and a cross slide guided on the guide part. The cross slide has a curved control link in which a control projection is guided, wherein the control projection is firmly connected to an actuating mechanism in the form of a drive rod.

DE 10 2014 220 837 B3 discloses an actuating mechanism with a roller assembly. The roller assembly comprises a guide part which can be arranged on a sash and a cross slide which can be displaced relative to the guide part and a roller bearing.

The fitting assemblies described at the outset are assembled in such a way that a basic fitting is first fitted to a sash. The positions of components, such as the guide part, are then drilled with drilling templates. The component is then mounted on the drilling pattern. The guide part is therefore screwed onto the sash, the position and location of the guide part is defined solely by the holes. When installing on the sash, a connecting rod of the basic fitting is coupled to the cross slide. This results in a great assembly effort for the processor. Many profile-specific drilling templates are necessary, which leads to increased workload and costs. Another problem is that some of the guide parts are mounted "at an angle," which makes the fitting assembly difficult to move. If the bores are inaccurate, the position of the guide part (relative to the control pin) and/or the alignment with the fitting groove or the displacement path of the control pin is no longer correct. In the case of guide parts mounted at an angle, an increased torque must be applied to a handle with which the actuating mechanism is driven.

SUMMARY OF THE INVENTION

The object of the present invention is to provide a fitting group with which assembly is simplified and sluggishness is avoided.

This object is achieved according to the invention by a pre-assembled fitting group for a window or a door, wherein the fitting group has the following:

a) a drive rod portion which is movable in the rebate circumferential direction;
b) a first control arranged on the drive rod portion;
c) a second control element which is arranged on a cross slide;
d) wherein the first and the second control element cooperate and are coordinated with one another in such a way that a displacement of the first control element by the drive rod section causes a displacement of the cross slide;
e) a guide part which can be fixedly mounted on the sash, wherein the cross slide is at least partially movable relative to the guide part.

Because the drive rod portion with the first control element is preassembled on the fitting group, the position of the guide part in relation to the control element is exactly correct. The movement of the drive rod portion and thus of the control element can always take place parallel to the longitudinal direction of the guide part.

At least one guide element can be provided for aligning the fitting group in or on a window or door, in particular a fitting groove of a sash. The guide element can in particular protrude downward and be designed to protrude into the fitting groove. The guide element can have a width which essentially corresponds to the width of the fitting groove. The guide element is preferably connected to the guide part or formed on it. This is particularly advantageous in the case of aluminum windows, in which no faceplate is usually provided. Alternatively or additionally, a fitting part that can be fixedly mounted on the sash, in particular a faceplate section, can be provided on the fitting group, via which the fitting group can be aligned on the sash. If the fitting group can be aligned on a fitting groove, the positional orientation of the fitting group and thus of the guide part is exactly correct. Sluggishness can be avoided in this way.

If the guide part is connected to a fitting part that can be fixedly mounted on the sash, the guide part can be mounted on the sash together with the other components of a fitting assembly. In particular, an actuating mechanism, in particular a drive rod, can be inserted into a fitting groove of the sash. Simultaneously with the drive rod, of which the drive rod section is a component, the guide part can be arranged together on the sash. Because the guide part is connected to a fitting part that can be fixedly mounted on the sash, this is already correctly arranged and aligned. In this context, "connected" is to be understood as meaning that the guide part and the fitting part are at most minimally movable relative to one another, for example within the scope of a desired play.

The drilling of fastening openings for fastening the guide part to the sash can be done using the guide part itself as a template. Additional drilling templates are not necessary. Sluggishness is avoided in that the guide part is already attached to the fitting part and is thus arranged in the correct orientation or can be correctly oriented via the guide element. An inclined assembly, i.e. a non-parallel alignment of the longitudinal axis of the guide part to the fitting groove, is impossible.

Particular advantages arise when the guide part is connected to the fitting part that can be fixedly mounted on the sash and/or is connected to the guide element, in particular the guide element is riveted, screwed, welded or otherwise connected to the guide part with play, or the guide element is formed on the guide part. The guide element can also be integrally formed on the guide part. Riveting is a simple way of fastening. If the guide part is riveted with play with the fitting part, tolerances can be compensated. The play is preferably only in the vertical direction (longitudinal direction of the rivet). In particular, it can be adapted to different fitting grooves. The guide part is preferably connected via at least two rivets to the fitting part that can be fixedly mounted on the sash, or two rivets are each connected to a guide element. If two rivets are provided, the guide part can automatically be correctly aligned in the rebate circumferential direction and thus parallel to the actuating mechanism. A rotation of the guide part relative to the rebate circumferential direction, in particular to the direction of movement of the actuating mechanism, can be avoided. As an alternative to the second rivet, a guide can be provided which, by itself or together with the first rivet, ensures correct alignment.

The fitting part that can be fixedly mounted on the sash can preferably be designed as a faceplate. A faceplate is often provided anyway, so that no additional fitting parts are necessary in order to fix the guide part in the correct orientation on the fitting assembly. For assembly purposes, the faceplate can be connected to the actuation mechanism, in particular the drive rod. A central fixing can fix the position of the drive rod or of a drive rod portion relative to the faceplate.

The faceplate can also be omitted in the area of the guide part. Generally, there is no faceplate for aluminum windows. A guide element then engages in the fitting groove for positional alignment. A center fixing can then be arranged between the guide part and the cross slide.

One of the control elements may be designed as a control contour that extends at least in portions transversely to the rebate circumferential direction and the other control element may be designed as a control projection that cooperates with the control contour. For example, a control projection may be provided on the portion of the drive rod, which control projection engages in a corresponding control contour of the cross slide. The control contour may, for example, be designed as a connecting link. In this way, the cross slide may be controlled in a particularly simple manner. In particular, the control projection can be arranged or formed on the drive rod portion and the control contour can be arranged or formed on the cross slide.

The cross slide can be guided on the guide part, wherein the transverse slide is guided transversely to the main plane of the sash, in particular perpendicular to the main plane of the sash. As a result, a movement of the drive rod portion in the rebate circumferential direction can be converted into a movement transverse to the rebate circumferential direction, in particular transverse to the main plane of the sash. The cross slide can be used and designed for different purposes. For example, the cross slide can be used to cause the sash to be tightened or pressed against a fixed frame, so that the sash is pressed against a seal which is arranged between the sash and the fixed frame. It is also conceivable that the cross slide is connected to a locking element and the sash is locked by moving the cross slide.

The cross slide can only be guided on the guide part with its outer ends, viewed in the rebate circumferential direction. In particular, dovetail-shaped guides previously provided in the prior art can be dispensed with in a central region of the cross slide. The guides are thus shifted to the outside. More material can thus be provided in the center of the guide part or of the cross slide, whereby the torsional rigidity of the cross slide and the guide part are increased. In addition, there are fewer tolerances with regard to a rotation of the cross slide relative to the guide part.

By using a fitting assembly according to the invention, ball bearings or roller bearings can also be used, for example for mounting the cross slide on the guide part and/or for guiding the control projection in the guide part and/or in the cross slide. Ball bearings or roller bearings can no longer be damaged due to a faulty, in particular inclined, installation of the guide part.

In addition, fewer fastening points can be provided. An assembly can now be mounted on the sash with fewer, in particular with 4 instead of 6 screws. The faceplate can also be screwed to the sash with fewer screws. This reduces the installation effort without reducing the stability of the connection between the fitting group and sash.

Particular advantages result if the fitting group is designed as a displacement assembly for displacing a sash of the window or door transversely to the main plane of a fixed frame of the window or door. In particular, a smooth displacement of the wing can thereby be achieved. The fact that the guide part can no longer be mounted "at an angle" on the sash, thus ensuring that the fitting group can move easily, the sash can be shifted toward the fixed frame with little effort.

For this purpose, the fitting group can have a roller assembly arranged or formed on the cross slide for moving the sash and/or a support assembly for support on the fixed frame. The support assembly can have a roller with an axis of rotation, wherein the axis of rotation in particular is parallel to the main plane of the wing and perpendicular, for example, to the faceplate.

Furthermore, only a single central fixing can be provided, in particular between the drive rod portion and the stationary fitting part, in particular the faceplate, or between the cross slide and the guide part. The central fixing can be released by moving the actuating mechanism in the rebate circumferential direction. In the prior art, it was necessary, when the guide part was retrofitted, that both of the aforementioned center fixations were present. This was associated with increased effort. In particular when several assemblies were assembled and the two center fixings of each of the several assemblies had to be released by a single drive rod movement, this was often only possible with increased effort. With the fitting assembly according to the invention, the central fixing of several assemblies of the fitting assembly can also be solved with little effort.

A thermal separation element can be arranged on the guide part. In particular, a thermal separation element can be provided if the guide part is to be mounted on an aluminum sash. The thermal separation element can be made of plastic, for example. It can be clipped onto the guide part.

The fitting group can be used as a drilling template. This simplifies assembly.

A fitting assembly with at least one fitting group according to the invention also falls within the scope of the invention, wherein the drive rod portion is part of an actuating mechanism. The fitting assembly can have several fitting groups. The various groups of fittings that are provided on a sash can be connected to one another by means of further elements, such as drive rod portions and faceplate portions.

A window or door with a fixed frame, a sash and a fitting assembly according to the invention also falls within the scope of the invention.

The sash can be designed in the form of a sliding sash that can be displaced relative to the fixed frame and moved parallel to the fixed frame.

Further features and advantages of the invention are apparent from the following detailed description of embodiments of the invention with reference to the accompanying drawings, which show details essential to the invention. The various features can each be implemented individually for themselves or for a plurality of combinations of any kind in variants of the invention. The features shown in the drawing are shown in such a way that the special features according to the invention can be made clearly visible.

BRIEF DESCRIPTION OF THE DRAWING FIGURES

DETAILED DESCRIPTION OF THE INVENTION

Figure 1:
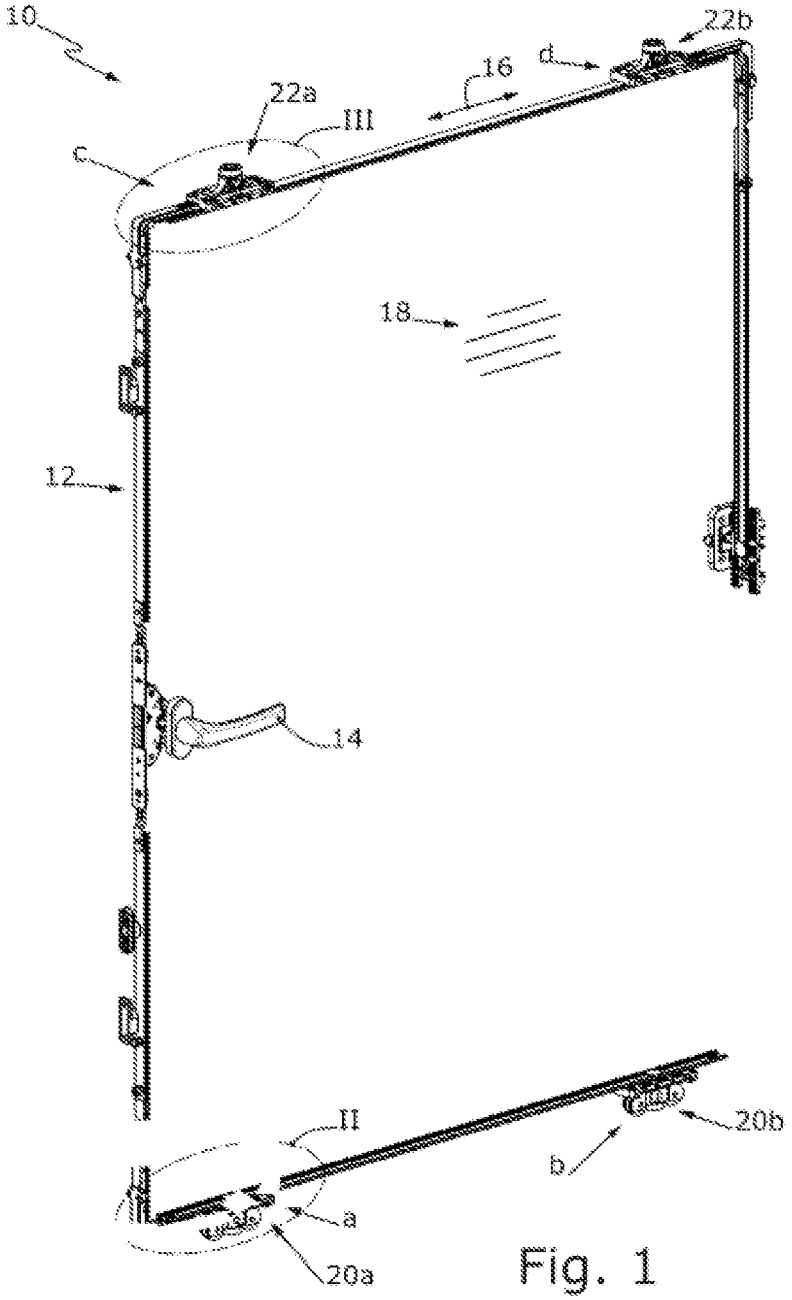
FIG. 1 is a representation of a fitting assembly.

FIG. 1 shows a fitting assembly 10 depicted as a displacement assembly with an actuating mechanism 12 designed as a circumferential drive rod fitting which can be operated via an actuating handle 14. The actuation mechanism 12 is attached to a/one window or door shown in FIGS. 8 and 9, and extends along the rebate circumferential direction 16. The rebate circumferential direction 16 extends in the main plane 18 (only indicated in FIG. 1) of the window or door. In the embodiment shown, the displacement assembly 10 has two points a, b with a roller assembly 20*a*, 20*b* and two points c, d with a support assembly 22*a*, 22*b*, wherein the roller assemblies 20*a*, 20*b* and the support assemblies 22*a*, 22*b* each are displaceable transversely to the rebate circumferential direction 16.

A locking assembly can also be seen on the right vertical spar, the locking element of which can also be displaced transversely to the rebate circumferential direction.

Figure 2:
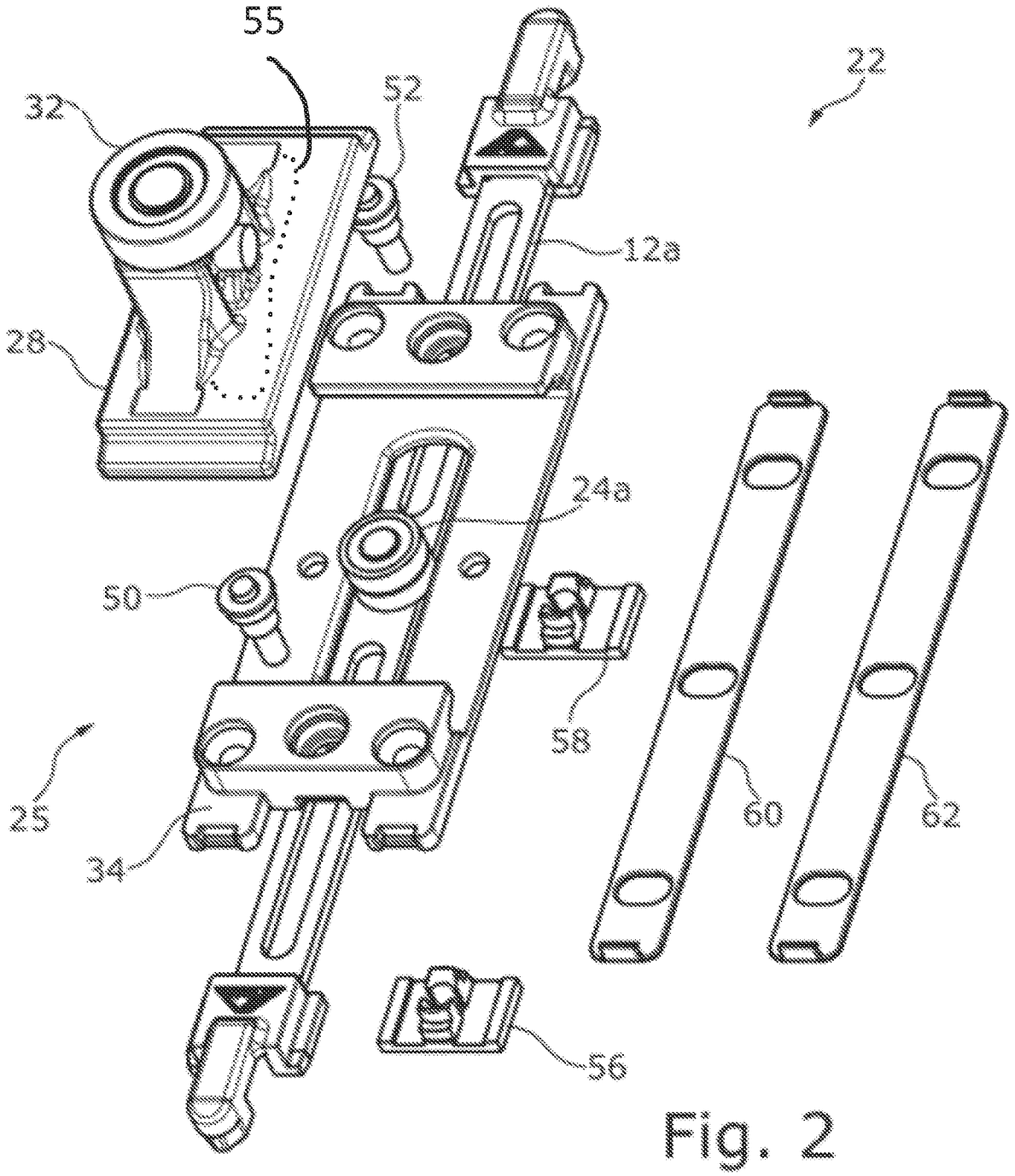
FIG. 2 is a partially exploded view according to II of FIG. 1.

FIG. 2 shows a representation of a fitting group 25 of the detail II according to FIG. 1. The support assembly 22*a* or fitting group 25 has a support roller 32 which is arranged to be rotatable about a vertical axis of rotation. The fitting group 25 has a cross slide 28 with a control element designed as a control link (not visible) into which a control element 24*a* designed as a control projection engages. Furthermore, the fitting group 25 has a guide part 34. The guide part 34 is connected via rivets 50, 52 to guide elements 56, 58, which are matched to a fitting groove and serve to align the fitting group 25. The rivets 50, 52 reach through elongated holes of the drive rod portion 12*a* and thus connect the components mentioned. The guide part 34 is immovably mounted on the sash 40 (see FIG. 8, 9). To reduce the friction when operating the drive rod portion 12*a* of the actuating mechanism 12, the control element 24*a* is mounted in the rebate circumferential direction 16 on a guide slot in the guide part 34. The control element 24*a* passes through the guide part 34 and engages in the cross slide 28, in particular a control contour 55 formed on its underside, shown here in broken lines.

Thermal separation elements 60, 62 can be arranged, in particular clipped on, on the underside of guide part 34. These thermal separation elements 60, 62 are arranged on the left and right of the drive rod section 12*a* between the guide part 34 and the sash profile. They prevent heat transfer through the guide part 34 from the outside to the inside of the sash profile (or vice versa).

Figure 3:
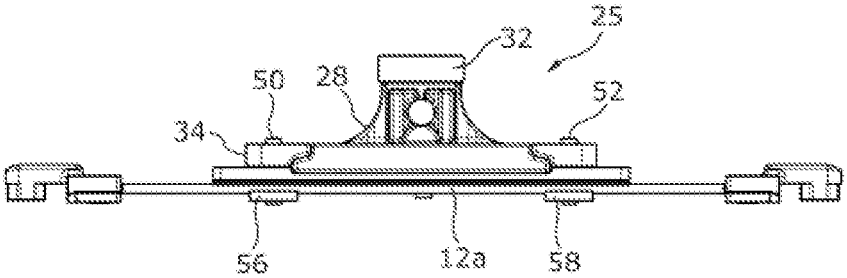
FIG. 3 is a side view of the illustration according to FIG. 2 in the assembled state.
Figure 4:
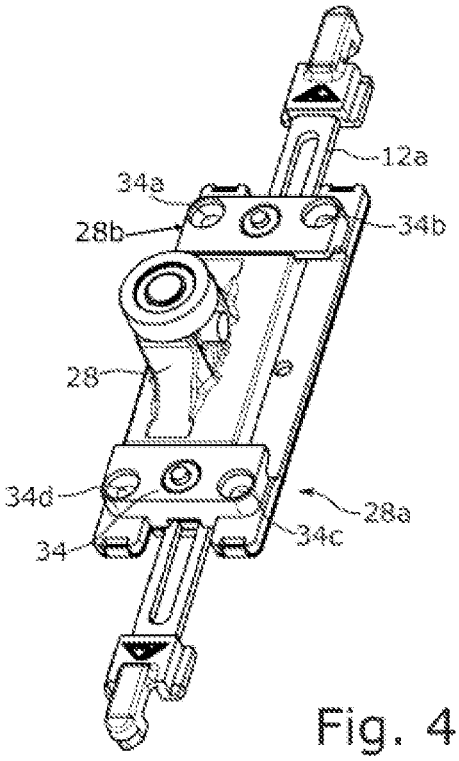
FIG. 4 is a perspective view of the assembly according to FIG. 3.

FIGS. 3 and 4 show the assembly according to FIG. 2 in a side view and in a perspective view from above. The same reference numbers are used as in FIG. 2. It can be seen from FIG. 1 that the fitting assembly 10 has different fitting groups 25, as shown by way of example by the support assembly 22*a*. These fitting groups can be mounted at different points on the sash 40 and connected to one another by connecting rod portions and, if necessary, by faceplate portions. The fitting parts of the fitting groups are connected to one another so that the fitting group can be mounted in its entirety on the sash 40. In FIG. 4, in particular, it can be seen that the cross slide 28 is guided on the guide part 34 only at its two opposite ends 28*a*, 28*b*. It can also be seen that the guide part 34 has fastening openings 34*a* to 34*d* with which the guide part 34 can be fastened to the sash 40. The fastening openings 34*a*-34*d* can be used as a drilling template.

Figure 5:
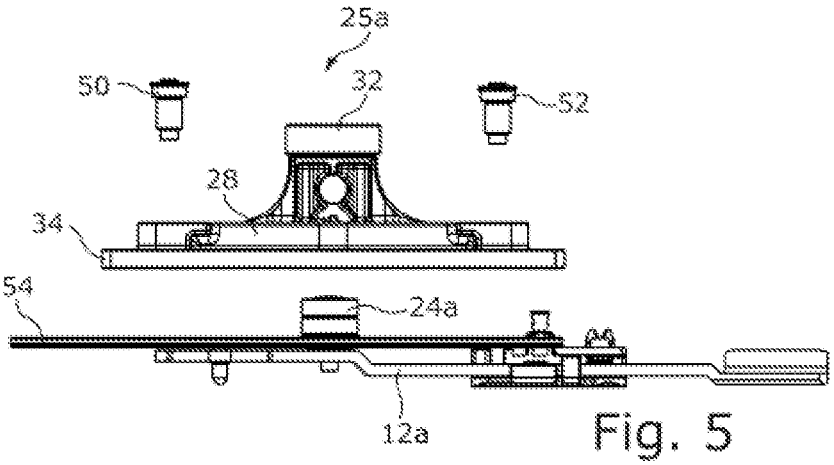
FIG. 5 is an exploded view of a fitting group with a faceplate.

FIG. 5 shows an illustration of a fitting group 25*a* similar to the fitting group 25 shown in FIG. 2. The fitting group 25*a* has a support roller 32 which is arranged to be rotatable about a vertical axis of rotation. The fitting group 25*a* has a cross slide 28 with a control element designed as a control link (not visible) into which a control element 24*a* designed as a control projection engages. Furthermore, the fitting group 25*a* has a guide part 34. The guide part 34 is fastened by means of rivets 50, 52 to a fitting part 54 which can be fixedly mounted or is fixedly mounted on the sash 40. The fitting part 54 is designed as a faceplate. The guide part 34 is immovably mounted on the sash 40 (see FIG. 5, 8, 9). In order to reduce the friction when operating the drive rod portion 12*a*, the control element 24*a* is mounted in the rebate circumferential direction 16 on a first guide slot (not shown) in the guide part 34. The control element 24*a* passes through the guide part 34 and engages in the cross slide 28, in particular a control contour formed on its underside.

Figure 6:
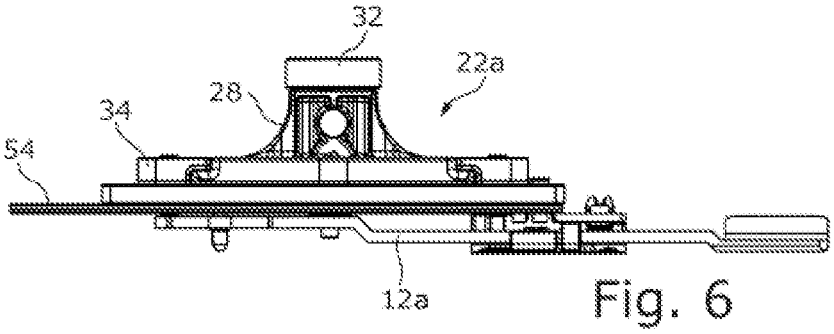
FIG. 6 is a side view of the illustration according to FIG. 5 in the assembled state.
Figure 7:
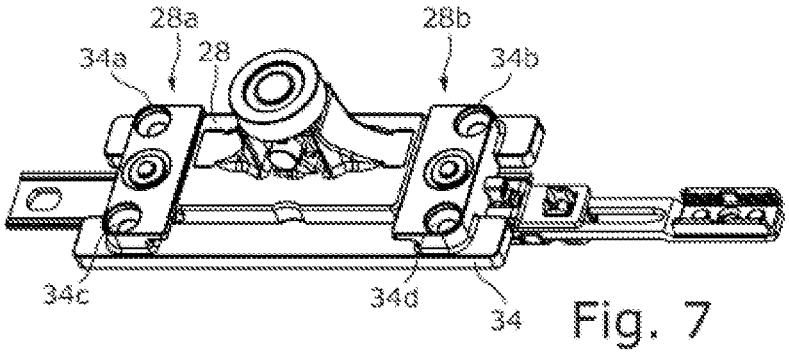
FIG. 7 is a perspective view according to FIG. 6.

FIGS. 6 and 7 show the assembly according to FIG. 5 in a side view and in a perspective view from above. The same reference numbers are used as in FIG. 5. In particular, it can be seen from FIG. 7 that the cross slide 28 is guided on the guide part 34 only at its two opposite ends 28*a*, 28*b*. It can also be seen that the guide part 34 has fastening openings 34*a* to 34*d* with which the guide part 34 can be fastened to the sash. The fastening openings 34*a*-34*d* can be used as a drilling template.

Figure 8:
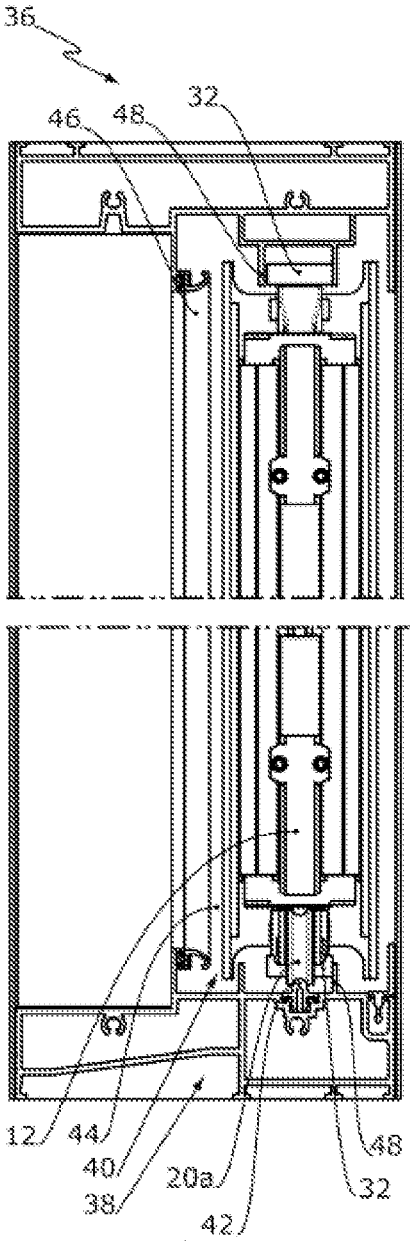
FIG. 8 is a view from the closure side of a sash with a closure assembly, wherein the sash is spaced apart from a fixed frame.

FIG. 8 shows a view from the locking side of a window or a door 36 having a fixed frame 38 and a sash 40. The actuation mechanism 12 is mounted on the sash 40. This is supported on a running rail 42 via the roller assembly 20*a*. There is a gap 44 between the sash 40 and the fixed frame 38. The sash 40 therefore does not rest against a circumferential seal 46 of the fixed frame 38.

The support roller 32 rests on a guide 48 of the fixed frame 38, which guide is designed as a vertical web. In the position shown, the sash 40 can be displaced with respect to the fixed frame 38, wherein the support roller 32 is supported on the guide 48 or is able to roll on it.

In the upper region of the window or door 36, the fixed frame 38 also has a guide 48, which here is designed like a groove. The support roller 32 is guided in the guide 48.

Figure 9:
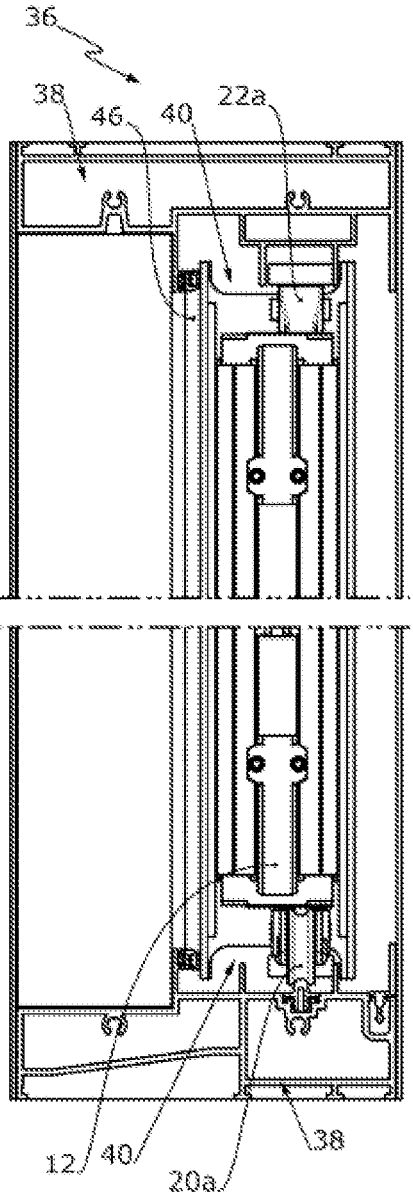
FIG. 9 is a representation corresponding to FIG. 8, wherein the sash is displaced in relation to the representation in FIG. 8 transversely to the main plane of the fixed frame.

FIG. 9 shows the window or door 36 after the actuation mechanism 12 has been operated. By actuating the actuating mechanism 12, the roller assemblies (in FIG. 9 the roller assembly 20*a* can be seen) and the support assemblies (in FIG. 9 the support assembly 22*a* can be seen) are displaced. This means that the sash 40 approaches the fixed frame 38 so that the seal 46 is pinched and compressed between the sash 40 and the fixed frame 38.

What is claimed is:

1. A pre-assembled fitting group for a window or door, the fitting group comprising:

(a) a drive rod portion which is movable in a rebate circumferential direction;

(b) a first control element which is arranged on the drive rod portion;

(c) a second control element which is arranged on a cross slide;

(d) wherein the first control element and the second control element cooperate and are coordinated with one another in such a way that a displacement of the first control element by the drive rod portion causes a displacement of the cross slide;

(e) a guide part that is configured to be fixedly mounted on a sash, wherein the cross slide is at least partially movable relative to the guide part, and wherein at least one guide element having a width corresponding to a width of a fitting groove of the window or door is provided for aligning the fitting group with the fitting groove of the window or door.

2. The fitting group according to claim 1, wherein the guide part is connected to or formed on the guide element.

3. The fitting group according to claim 2, wherein the guide part is riveted or screwed to the guide element.

4. The fitting group according to claim 1, wherein one of the control elements is designed as a control contour that extends at least in portions transversely to the rebate circumferential direction and wherein the other control element is designed as a control projection that cooperates with the control contour.

5. The fitting group according to claim 4, wherein the control projection is arranged or formed on the drive rod portion and the control contour is arranged or formed on the cross slide.

6. The fitting group according to claim 1, wherein the cross slide is guided on the guide part, and wherein the cross slide is guided transversely to a main plane of the sash.

7. The fitting group according to claim 1, wherein the cross slide is guided on the guide part exclusively with its outer ends of the cross slide seen in the rebate circumferential direction.

8. The fitting group according to claim 1, wherein the fitting group has a roller assembly arranged or formed on the cross slide, or a support assembly for supporting on a fixed frame.

9. The fitting group according to claim 1, wherein a thermal separating element is arranged on the guide part.

10. The fitting group according to claim 1, wherein the guide part is configured to be used as a drilling template.

11. A fitting assembly with at least one fitting group according to claim 1 and an actuating mechanism, wherein the drive rod portion is part of the actuating mechanism.

12. A window or door with a fixed frame, a sash and the fitting assembly according to claim 11.

13. The window or door according to claim 12, wherein the sash is designed in the form of a sliding sash which is configured to be displaced relative to the fixed frame and moved parallel to the fixed frame.

14. A pre-assembled fitting group for a window or door, the fitting group comprising:

(a) a drive rod portion which is movable in a rebate circumferential direction;

(b) a first control element which is arranged on the drive rod portion;

(c) a second control element which is arranged on a cross slide;

(d) wherein the first control element and the second control element cooperate and are coordinated with one another in such a way that a displacement of the first control element by the drive rod portion causes a displacement of the cross slide; and (e) a guide part that is configured to be fixedly mounted on a sash and which is connected to or formed on a face plate which is configured to be fixedly mounted on the sash, wherein the cross slide is at least partially movable relative to the guide part, and wherein the face plate is provided for aligning the fitting group with a fitting groove of the window or door.

15. The fitting group according to claim 14, wherein only a single central fixation is provided, between the drive rod portion and the face plate, or between the cross slide and guide part.

16. The fitting group according to claim 14, wherein the guide part is riveted or screwed to the face plate.

17. A fitting assembly with at least one fitting group according to claim 14 and an actuating mechanism, wherein the drive rod portion is part of the actuating mechanism.

18. A window or door with a fixed frame, a sash and the fitting assembly according to claim 14.

19. The window or door according to claim 18, wherein the sash is designed in the form of a sliding sash which is configured to be displaced.

* * * * *